US007676903B1

(12) United States Patent
Weller et al.

(10) Patent No.: US 7,676,903 B1
(45) Date of Patent: Mar. 16, 2010

(54) MICROELECTROMECHANICAL SLOW-WAVE PHASE SHIFTER METHOD OF USE

(75) Inventors: Thomas Weller, Lutz, FL (US); Balaji Lakshminarayanan, Tampa, FL (US)

(73) Assignee: University of South Florida, Tampa, FL (US)

( * ) Notice: Subject to any disclaimer, the term of this patent is extended or adjusted under 35 U.S.C. 154(b) by 230 days.

(21) Appl. No.: 11/782,821

(22) Filed: Jul. 25, 2007

Related U.S. Application Data

(62) Division of application No. 10/906,626, filed on Feb. 28, 2005, now Pat. No. 7,259,641.

(60) Provisional application No. 60/521,146, filed on Feb. 27, 2004.

(51) Int. Cl.
*H01P 11/00* (2006.01)

(52) U.S. Cl. ..... 29/600; 333/156; 333/161; 343/776; 29/592.1; 29/622

(58) Field of Classification Search ..... 29/600, 29/601, 825, 830, 592.1, 594, 595, 25.35–25.42; 333/208, 238, 156, 161–163; 343/775–778, 343/762, 700 MS; 340/572.2–572.7
See application file for complete search history.

(56) References Cited

U.S. PATENT DOCUMENTS 6,133,807 A 10/2000 Akiyama et al.
6,621,387 B1 9/2003 Hopcroft
6,678,943 B1 * 1/2004 Feng et al. ..... 29/600
7,259,641 B1 * 8/2007 Weller et al. ..... 333/161
2003/0146806 A1 8/2003 Nuecther et al.

OTHER PUBLICATIONS

Lakshminarayanan, B. and Weller, T. "MEMS Phase Shifters Using Cascaded Slow-Wave Structures for Improved Impedance Matching and/or Phase Shift," 2004 IEEE MTT-S, vol. 2, pp. 725-728.

* cited by examiner

*Primary Examiner*—Minh Trinh
(74) *Attorney, Agent, or Firm*—Molly L. Sauter; Smith & Hopen, P.A.

(57) ABSTRACT

/The present invention provides a method of use for a monolithic device utilizing cascaded, switchable slow-wave CPW sections that are integrated along the length of a planar transmission line. The purpose of the switchable slow-wave CPW sections element is to enable control of the propagation constant along the transmission line while maintaining a quasi-constant characteristic impedance. The method can be used to produce true time delay phase shifting components in which large amounts of time delay can be achieved without significant variation in the effective characteristic impedance of the transmission line, and thus also the input/output return loss of the component. Additionally, for a particular value of return loss, greater time delay per unit length can be achieved in comparison to tunable capacitance-only delay components.

10 Claims, 14 Drawing Sheets

Fig. 8

| | Shunt Beam (μm) | Ground Plane Beam(μm) |
|---|---|---|
| Width | 40 | 70 |
| Length | 440 | 285 |
| Actuation Voltage | 30V | 45V |

MICROELECTROMECHANICAL SLOW-WAVE PHASE SHIFTER METHOD OF USE

CROSS-REFERENCE TO RELATED APPLICATIONS

This application is a divisional application of U.S. patent application Ser. No. 10/909,626, now U.S. Pat. No. 7,259,641, filed on Feb. 28, 2005, entitled: "Microelectromechanical Slow-wave Phase Shifter Device and Method". This application claims priority to provisional application entitled: "True Time Delay Phase Shifting Method and Apparatus with Slow-Wave Elements," filed Feb. 27, 2004 by the present inventors and bearing application No. 60/521,146.

GOVERNMENT SUPPORT

This invention was developed under support from the National Science Foundation under grant/contract number ECS9875235; accordingly the U.S. government has certain rights in the invention.

BACKGROUND OF THE INVENTION

A true time delay (TTD) phase shifter is a component used in microwave and millimeter wave radar and communications systems to control the time delay imposed upon a signal along a particular signal path within a system. The most common use of TTD components is within phased array radars, where it is possible that thousands of TTD components may be necessary and would be connected to each antenna element within a large array of such elements. In such an example the TTD components would facilitate electronic steering of the transmit and/or receive direction of the antenna array. The most common implementation of TTD components using current technology is in the form of a monolithic microwave integrated circuit (MMIC), in which transistors are used to realize switches, and these switches are used to select among different sections of transmission lines of varying length, thus enabling a tuning of the time delay. In the past 3-4 years new implementations of TDD components have been developed based upon the use of radio frequency micro electro mechanical systems (RF MEMS).

Distributed micro electro-mechanical (MEM) transmission lines (DMTLs) are a proven solution for very high performance, low loss true time delay phase shifters. The DMTL, as known in the art, usually consists of a uniform length of high impedance coplanar waveguide (CPW) that is loaded by periodic placement of discrete MEM capacitors. The MEM devices are typically designed such that S11 for a DMTL section is less than −10 dB for the two phase states, i.e. with MEM capacitors in the up- and down-state positions. The increase in the distributed capacitance in the down-state provides a differential phase shift ($\Delta\phi$) with respect to the phase in the upstate.

A limitation of the capacitively-loaded DMTL known in the prior art is that the amount of phase shift is proportional to the difference in the loaded and unloaded impedances, thus restricting the achievable $\Delta\phi$ per unit length in light of impedance matching considerations.

Today, a large phased array radar system can cost millions of dollars. This cost can be lowered by orders of magnitude through the use of MEMS technologies. Still, there is a physical limitation to the performance achievable with RF MEMS TTD devices that operate only on the change of the capacitive loading of a transmission line. As the capacitance changes, a property of the transmission line known as the characteristic impedance (Zo) changes along with the desired change in the propagation constant. As Zo changes, there is a mismatch that arises between the TTD device and the system in which it is integrated, causing power to be reflected from the TTD device input. This mismatch is often described in terms of a parameter known as return loss (RL). A generally accepted upper limit for RL is 10 dB. The physical limitation of the capacitive only TTD device is that the amount of time delay per unit length of transmission line that can be achieved is restricted by the need to keep RL>10 dB. As one attempts to achieve greater time delay, larger changes in Zo are inherently produced, thereby decreasing the RL.

What is needed in the art is a device that improves upon the capacitance-only TTD device architecture currently known in the art. Accordingly, a device that produces true time delay phase shifting in which large amounts of time delay can be achieved without significant variation in the effective characteristic impedance of the transmission line, and thus also the input/output return loss of the component, would solve the problem of the devices currently known in the art for use in the microwave and mm-wave industry.

SUMMARY OF INVENTION

The present invention provides a method and apparatus for RF MEMS TTD components in which RF MEMS tunable components are placed along the length of a transmission line. As the mechanical configuration of the MEMS devices is changed, through electro static actuation, the effective loading on the transmission line is changed, which in turn changes the propagation constant and the corresponding time to propagate along the transmission line.

In accordance with the present invention, a microelectromechanical slow-wave phase shifter device and method of use are provided including at least one center conductive element, at least two ground plane elements laterally located proximal to the center conductive element, the at least two ground plane elements having a slot formed within, at least one actuatable ground shorting beam and an actuatable shunt beam configured to control access to the slot formed in the at least two ground plane elements.

The actuatable ground shorting beam further includes a first two actuatable ground shorting beams having electrical connectivity to a first of the two laterally located ground plane elements, and a second two actuatable ground shorting beams having electrical connectivity to a second of the two laterally located ground plane elements and a ground shorting beam bias line to control actuation of the ground shorting beams. In a particular embodiment, the slot formed in the ground plane has entrance point and an exit point to the transmission. As such, a first of the two actuatable ground shorting beams controls access to the entrance point and a second of the two actuatable ground shorting beams controls access to the exit point of the slot.

The actuatable shunt beam is suspended over the center conductive element and electrically connects the two ground plane elements. A shunt beam bias line is used to control actuation of the shunt beam.

In a particular embodiment, the actuation of the shunt beam and the ground shorting beams are controlled by an electrostatic supplied through the appropriate bias line.

The slow-wave device of the present invention can be prefabricated and then integrated with a planar transmission line having a center conductor and two laterally located ground planes on either side of the center conductor. In this configuration, the center conductive element is electrically connected to the center conductor of the planar transmission line and each of the two ground plane elements are electrically connected to each of the two laterally located ground planes of the transmission line.

In an additional embodiment, a plurality of conductive slots may be formed to provide additional propagation delay and the ability to have a multi-bit system. With this configuration, at least two ground plane elements are laterally located proximal to the center conductive element, and the at least two ground plane elements include a plurality of conductive slots formed within and electrically isolated from each other. As such, a plurality of actuatable ground shorting beams and a plurality of actuatable shunt beams are configured to control access to the slots formed in the at least two ground plane elements. The plurality of actuatable ground shorting beams and the plurality of actuatable shunt beams may be addressed either individually or simultaneously. This configuration allows for a multi-bit phase shifter.

In a particular embodiment, the actuation of the plurality of actuatable ground shorting beams and the plurality of actuatable shunt beams is such that a multi-bit phase shifter for use as a tunable true-reflect-line calibration set is provided.

In comparison to the MMIC devices currently known in the art, the RF MEMS TTD components in accordance with the present invention provide better performance (lower loss) and significantly lower cost. The present invention improves upon the capacitance-only TTD device architecture by introducing cascaded, switchable slow-save CPW sections. Theoretically, the time delay can be increased to any value while maintaining a fixed value for Zo. As such, dramatic improvements upon the current state of the art (SOTA) have been demonstrated.

The present invention enables the production of a new class of TTD devices that offer higher performance, smaller size and lower cost. In accordance with the present invention a new true time delay MEM phase shifter topology is presented that overcomes the limitations of the capacitor-only DMTL. The topology uses cascaded, switchable slow-wave CPW sections to achieve high return loss in both states, a large $\Delta\phi$ per unit length, and phase shift per dB that is comparable to previously reported performance In a particular embodiment, the slow-wave MEM device in accordance with the present invention achieved a greater than 20 dB return loss in both states with the maximum $\Delta\phi$. Experimental results for a single, 460 micron long slow-wave unit-cell demonstrate RL greater than 22 dB through 50 GHz with $\Delta\phi$~41° at 50 GHz. A 4.6 mm-long phase shifter comprised of 10 slow-wave unit-cells provides a measured $\Delta\phi$ per dB of approximately 317°/dB (or 91°/mm) at 50 GHz with RL greater than 21 dB.

In an alternate design the slow wave structure was also loaded with discrete MEM capacitors. For this design, the measured $\Delta\phi$ per dB is 257°/dB at 50 GHz with RL greater than 19 dB. This topology provides an attractive alternative for increasing the phase shift per dB if the constraint on the return loss is reduced. In a particular embodiment, a reconfiguration MEMS-based transmission line is provided in which there is independent control of the propagation delay and the characteristic impedance. In accordance with this embodiment, separate control of inductive and capacitive MEMS slow-wave devices in accordance with the present invention are used either to maintain a constant LC product (constant $Z_o$) or a constant L/C ratio (constant $\beta$), while changing the ratio or product, respectively. This embodiment employs metal-air-metal capacitors at the input and output of each of the slow-wave sections.

Accordingly, the present invention provides a device and method that improves upon the capacitance-only TTD device architecture currently known in the art. The slow-wave device in accordance with the present invention produces true time delay phase shifting in which large amounts of time delay that are achieved without significant variation in the effective characteristic impedance of the transmission line, and thus also the input/output return loss of the component.

BRIEF DESCRIPTION OF THE DRAWINGS

For a fuller understanding of the invention, reference should be made to the following detailed description, taken in connection with the accompanying drawings, in which:

FIG. 8 is a table of exemplary characteristics of the slow-wave unit-cell in accordance with the present invention.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

The differential phase shift between the up- and down-states of a DMTL with capacitive-loading is accompanied by a change in the effective characteristic impedance in each state. Using the quasi-TEM assumption, the relationship between phase shift for a DMTL of length L and characteristic impedance is derived as shown below in Equation 1. Assuming a reference impedance of 50□, $Z_{up}$ and $Z_{dn}$ need to be approximately 55Ω and 45.4Ω, respectively, in order to maintain RL greater than 20 dB. The resulting Δϕ per unit length is 17.8°/mm at 50 GHz. Achieving this small variation in the impedance requires tight control over the value of the MEM capacitor in the up- and down-state positions.

$$\Delta\phi = \left(\frac{\omega Z_0\sqrt{\varepsilon_{eff}}}{c}\right)\cdot\left(\frac{1}{Z_{up}} - \frac{1}{Z_{dn}}\right)\cdot L\text{rad} \tag{1}$$

Figure 1:
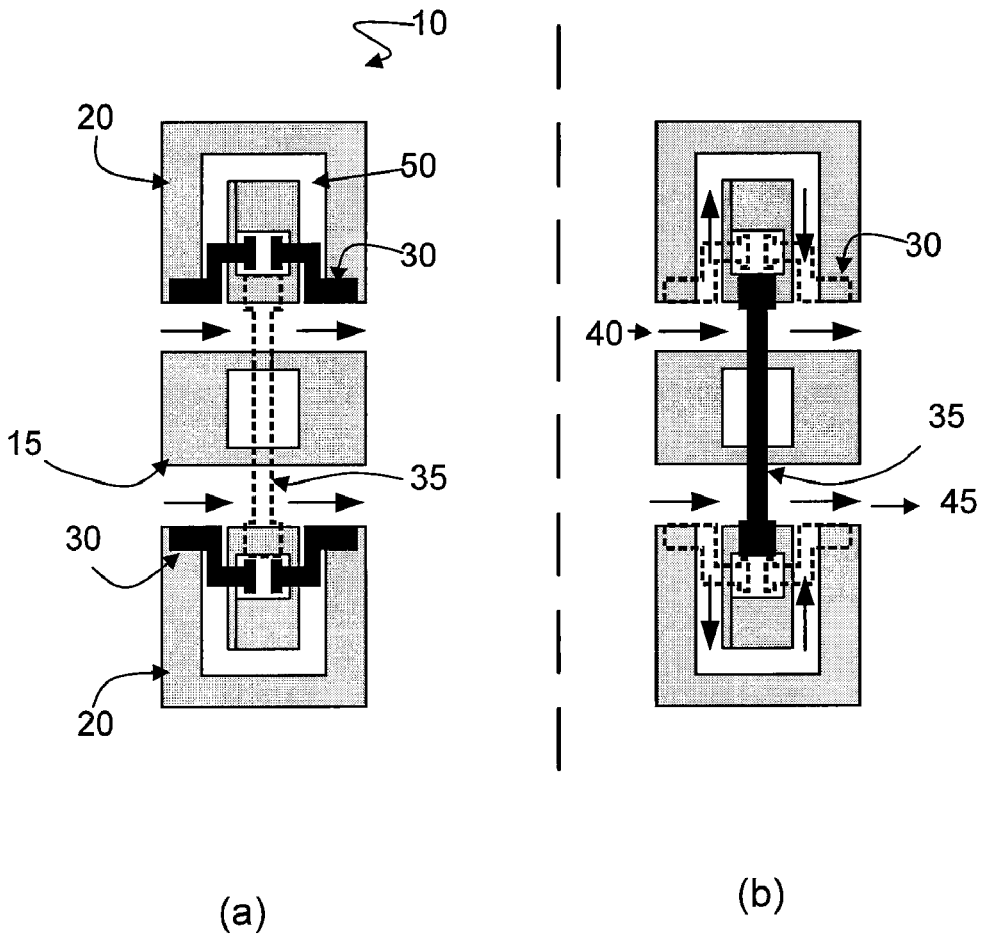
FIG. 1 is an illustrative schematic of the slow wave structure in the Normal and Slow-wave states in accordance with the present invention.
Figure 2:
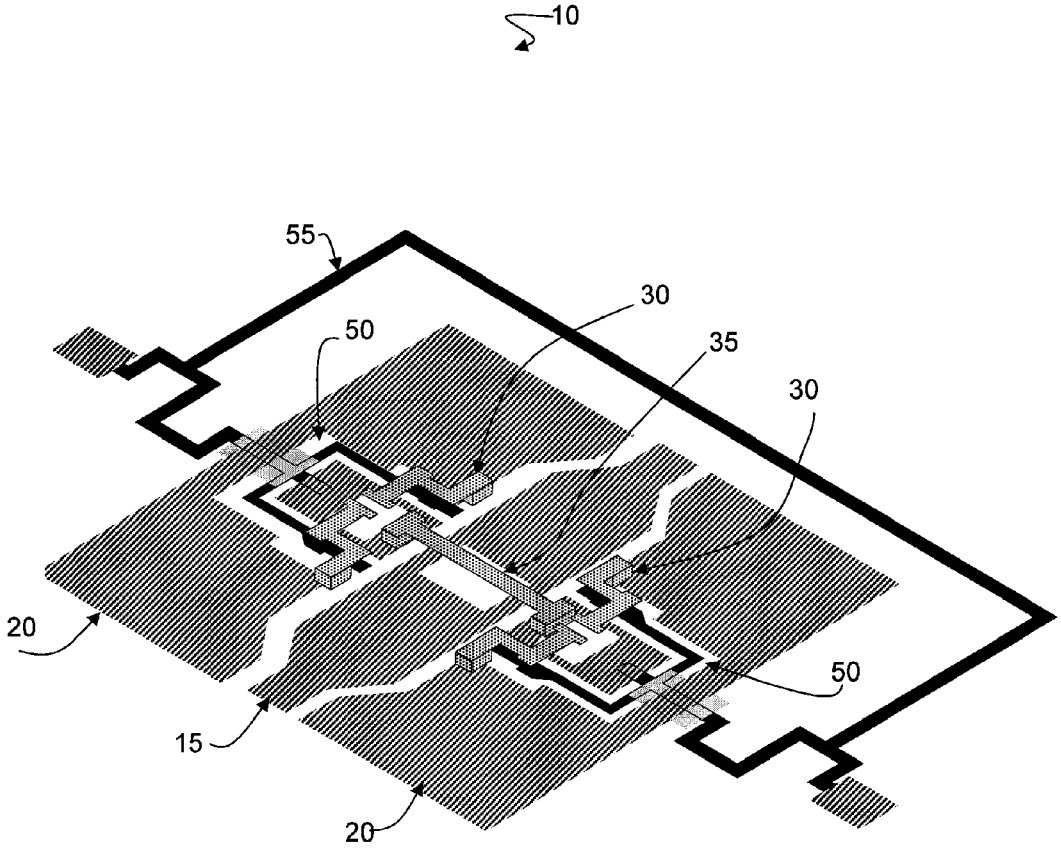
FIG. 2 is an illustrative 3-dimensional view of the slow-wave unit cell in accordance with the present invention.

The MEM slow-wave unit-cell 10 shown in FIG. 1 is designed to provide small variations in the impedances around 50Ω, with a Δϕ per unit length that is comparable to (and greater than) a capacitively-loaded DMTL that has a worst-case RL near 10 dB. In an exemplary embodiment, the unit-cell is 460 cm long and consists of two beams 30 on each ground plane 20 and a shunt beam 35 that connects the ground planes 20 and is suspended over the center conductor 15. In the normal state, FIG. 1(*a*), the beams on each ground plane 30 are actuated (solid lines) with electrostatic force applied through SiCr bias lines, while the shunt beam 35 is in the non-actuated state (dashed lines). In this normal state the signal travels directly from the input 40 to the output 45. In the slow-wave state, FIG. 1(*b*), the beams on the ground plane 30 are in the non-actuated state while the shunt beam 35 is actuated to contact the center conductor 15. The signal thus travels the longer path through the slot 50 in the ground plane 20, thereby increasing the time delay. FIG. 2 provides a three-dimensional view of the slow-wave device in accordance with the present invention. The physical characteristics of a beam in an exemplary embodiment are given in Table 1 of FIG. 8. Various alternate dimensions are within the scope of the present invention.

Figure 14:
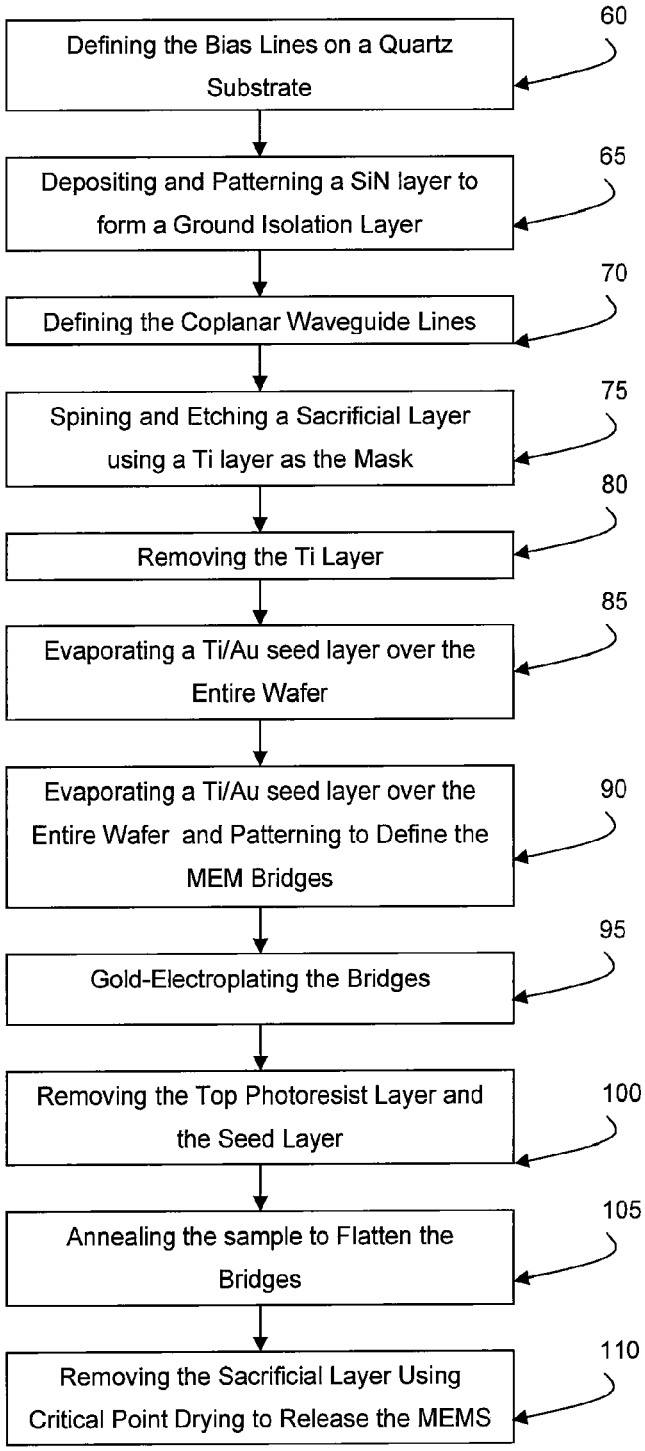
FIG. 14 is an illustrative flow diagram of a method of manufacturing of the slow-wave device in accordance with the present invention.

As shown with reference to the flow diagram of FIG. 14, in an exemplary embodiment, the phase shifters were fabricated on a 500 μm thick quartz substrate ($\in_r$=3.78, tan δ=0.0004). In an exemplary embodiment of the method of manufacturing of the MEM slow-wave device, the SiCr bias lines are defined first using the liftoff technique by evaporating a 1000 Å layer of SiCr using E-beam evaporation 60. The measured line resistivity is approximately 2000 Ω/sq. Next a 4000 Å RF magnetron sputtered $Si_xN_y$ layer is deposited and patterned to form the ground isolation layer 65. This layer is located where the SiCr bias lines enter the ground conductor. Next the CPW lines are defined by evaporating a Cr/Ag/Cr/Au to a thickness of 150/8000/150/1500 Å using liftoff technique 70. Next the sacrificial layer (MICROCHEM PMMA), is spin coated and etched in a reactive ion etcher (RIE) using a 1500 Å Ti layer as the mask 75. The PMMA layer thickness can be varied from 1.5-2 μm by varying the rotational speed of the spinner from 2500-1500 rpm. In a particular embodiment, the thickness of PMMA is optimized to provide a height of 1.8-2 μm. Next, the Ti layer is removed 80 and a 100/2000 Å Ti/Au seed layer is evaporated over the entire wafer and patterned with photoresist to define the width and the spacing of the MEM bridges 85. The bridges are then gold-electroplated to a thickness of 1 μm 90, followed by removal of the top photoresist layer and seed layer 95. The sample is then annealed at 105° and 120° to flatten the bridges 100 before removing the sacrificial PMMA layer. The sacrificial PMMA layer is removed 105 and critical point drying is used to release the MEMS structures 110. The fabrication steps outlined above are not intended to be limiting and other fabrication methods and processes are within the scope of the present invention.

Measurements of the slow-wave device were performed from 1-50 GHz using a Wiltron 360B vector network analyzer and 150 μm pitch GGB microwave probes. A Thru-Reflect-Line (TRL) calibration was performed using calibration standards fabricated on the wafer. A high voltage bias tee was used to supply voltage through the RF probe to avoid damaging the VNA test ports. Typical actuation voltages are shown in Table 1 of FIG. 8.

Figure 3:
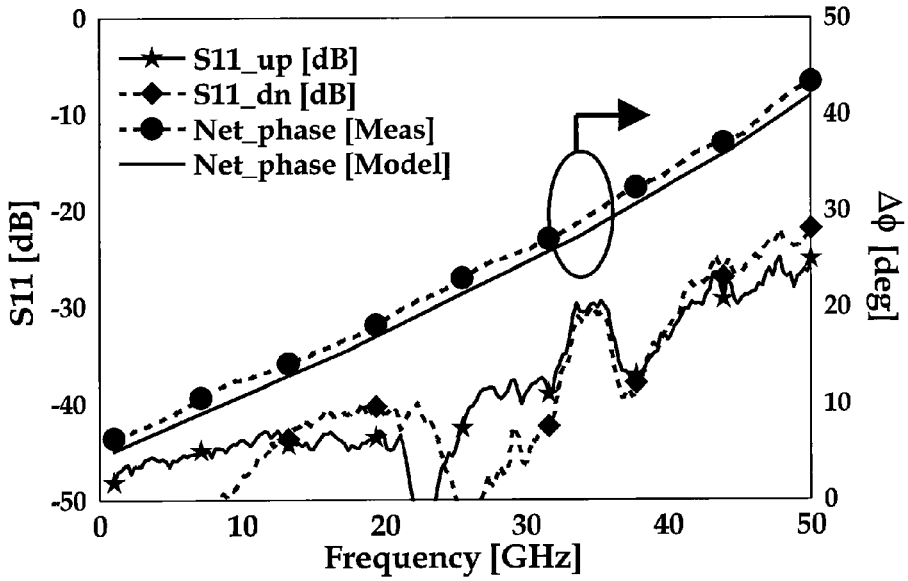
FIG. 3 is an illustrative view of the measured differential phase shift and S11 for the unit-cell in FIG. 1. The return loss (RL) is equal to the negative of S11 in dB. The solid line for $\Delta\phi$ curve represents EM simulation data and the dashed lines represent measured data.

FIG. 3 shows the measured Δϕ and S11 for both states of the slow-wave unit-cell. It is seen that Δϕ is approximately 41° at 50 GHz and S11 is below −22 dB from 1-50 GHz. The worst-case S21 is −0.17 dB for both states.

The measured unit-cell data was fitted to an ideal transmission line model in a circuit simulator to extract the effective characteristic impedance and effective length in each state. The effective characteristic impedance is approximately 52.1Ω for the normal state and 50.9Ω for the slow-wave state. Using the same approach but with results from a full-wave EM simulation using ADS Momentum™ yielded 51.9Ω (normal) and 50.3Ω (slow-wave). Assuming an effective relative dielectric constant of 2.34, the effective length in the normal state is 600 μm and in the slow-wave state it is approximately 1078 μm, resulting in a slowing factor of 1.8.

Figure 4:
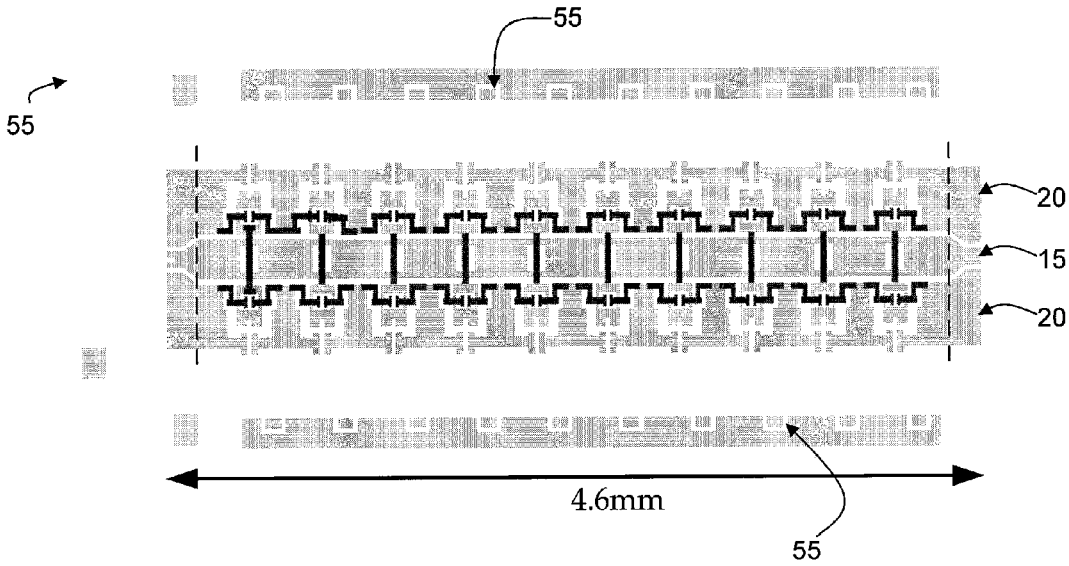
FIG. 4 is an illustrative view of a schematic of the phase shifter in accordance with the present invention. The phase shifter has 10 cascaded slow-wave unit-cells.

The schematic of the phase shifter with ten cascaded slow-wave sections is shown in FIG. 4. For a 1-bit version, the ground plane or shunt beams in all sections are actuated simultaneously. However, given the SiCr bias line configuration 55, it is possible to provide independent bias for a multi-bit operation.

Figure 5:
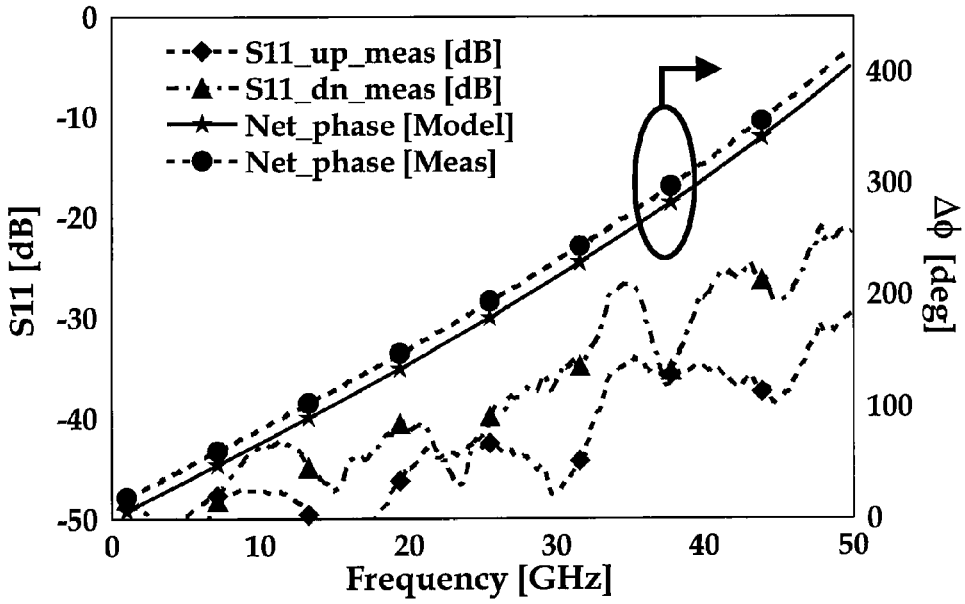
FIG. 5 is an illustrative view of the measured S11 and differential phase shift of the 10-section slow-wave phase shifter in accordance with the present invention. The solid line for $\Delta\phi$ curve represents EM simulation data and the dashed lines represent measured data. The return loss (RL) is equal to the negative of S11 in dB.

FIG. 5 shows the measured S11 for the phase shifter in both states and a comparison of the differential phase shift between measured and simulated results. (The simulated results were obtained by cascading full-wave analysis data for the unit-cells in the circuit simulator.) The measured S11 is below −23 dB for both states from 1-50 GHz. Furthermore, the measured and simulated differential phase shift is within 5%, with a measured value of 420° at 50 GHz. The discrepancy in the predicted phase shift can be attributed to the slight increase in the effective impedance of the fabricated circuit, which is approximately 53.55Ω/50.38Ω versus the design values of 52.1Ω/50.9Ω.

Figure 6:
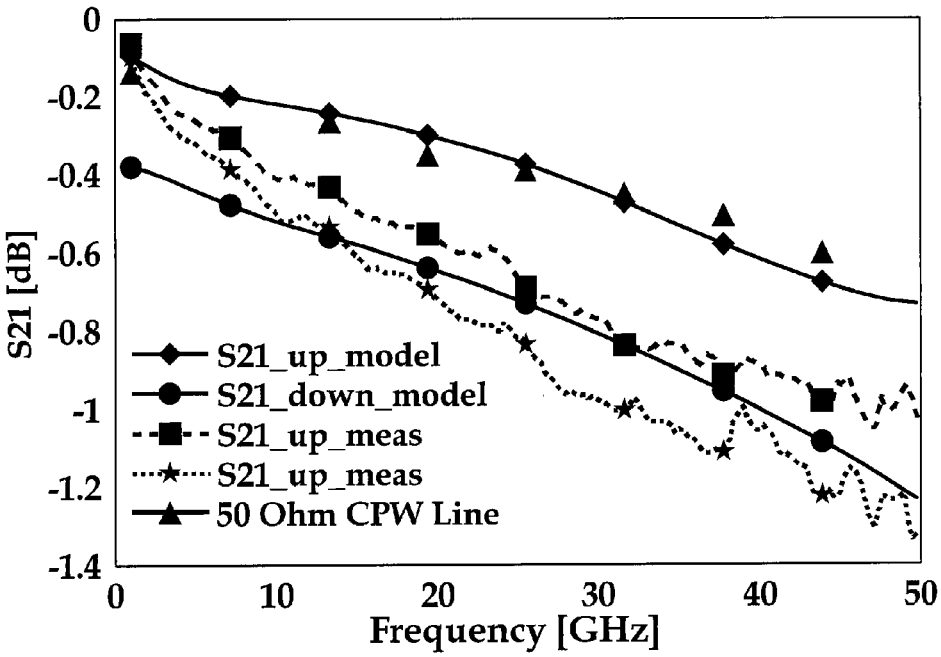
FIG. 6 is an illustrative view of the measured S21 (insertion gain) for both states of the 10-section phase shifter in accordance with the present invention. Solid lines represent EM simulation data and dashed lines represent measured data.

FIG. 6 shows a comparison between the measured insertion loss and EM simulation results for the phase shifter in both states. The measured insertion loss in the normal state is −0.9 dB at 50 GHz, which is higher than the simulated result by 0.3 dB. The graph also shows the measured S21 for a 50Ω CPW line that is 4.6 mm long. It is seen from FIG. 6 that the measured S21 for the slow wave phase shifter in both the states is dominated by transmission line loss for frequency <10 GHz. At higher frequencies, the increase in loss may be due to leakage in the bias circuitry and/or conductor roughness at the edges of the transmission line, which is difficult to account for in the EM simulation. The insertion loss can be improved by creating an air-bridge where the SiCr bias lines enter the ground plane (thereby avoiding the nitride ground isolation layer) and/or by plating the CPW lines.

In an alternate embodiment of the present invention, a MEM capacitor was cascaded with the unit-cell. This design is similar to a DMTL phase shifter with a uniform length of transmission line being replaced with the slow-wave unit-cell. The MEM capacitor is actuated only when the unit-cell is in the slow-wave state. The capacitance ratio is approximately 3.7 ($C_{unloaded}$=30 fF; $C_{loaded}$=8 fF) and chosen such that S11 remains less than −20 dB. The phase shifter illustrate in the figure is operated in a 1-bit version although a multi-bit version is possible by addressing the tuning elements individually and is within the scope of the present invention.

Figure 7:
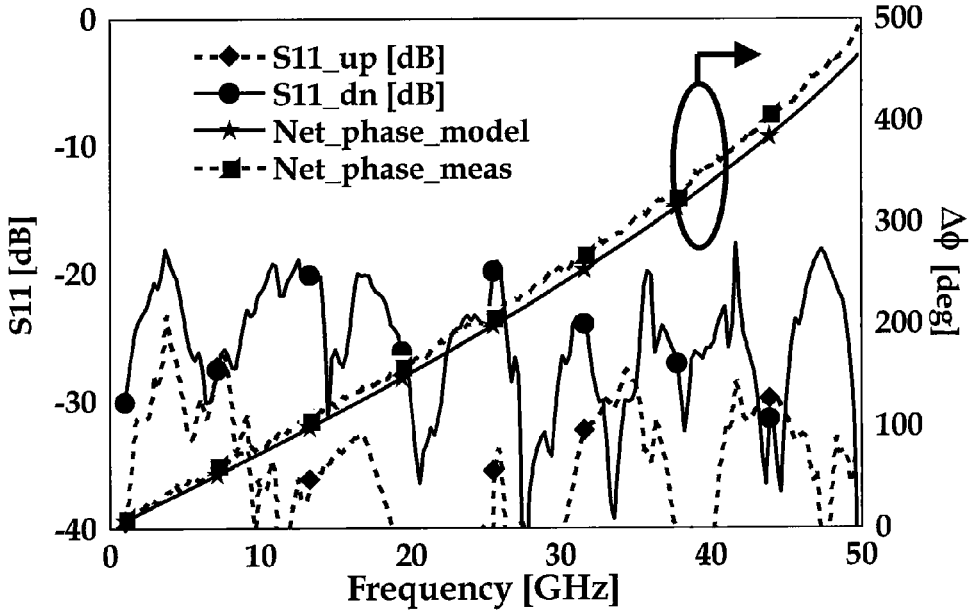
FIG. 7 is an illustrative view of the comparison of S11 and differential phase shift for both the states in accordance with the present invention. Solid lines represent EM simulation data and dashed lines represent measured data.

FIG. 7 shows the measured S11 for the phase shifter in both states and a comparison of the measured and simulated differential phase shift. The measured S11 is below −19 dB and the worst case insertion loss is approximately −1.9 dB from 1-50 GHz. In comparison to the slow-wave only design, the differential phase shift increases by a factor 17.2% at 50 GHz to 490°, however there is less Δϕ per mm. The Δϕ per mm can be improved by eliminating the length of CPW line on either side of the MEM capacitor (250 μm per unit-cell). Furthermore, the differential phase shift is also easily adjusted by changing the capacitance ratio of the MEM capacitor, especially when lower return loss performance can be tolerated.

In an additional embodiment, a 2-bit version of the capacitively loaded phase shifter was designed to provide Δϕ of 45° and 90° at 25 GHz. Experimental results for the 2-bit version resulted in Δϕ of 49.3° and 81.5° with S11<−21 dB through 50 GHz and the worst case insertion loss <1.15 dB.

In accordance with the present invention, a true-time-delay CPW phase shifter operating from 1-50 GHz is presented that utilizes slow-wave MEM sections. The measured S11 for a slow-wave unit-cell is below −20 dB with a differential phase shift of 34° at 40 GHz. A phase shifter comprised of 10 slow-wave unit-cells is shown to have S11 less than −20 dB with a phase shift of 317° at 40 GHz. The predicted and measured results for the phase shift agree to within 5%. In one embodiment of the invention, the goal was to keep S11 below −20 dB. However, if the constraint on S11 is relaxed to −10 dB the simulated phase shift is approximately 450° at 40 GHz. The unit-cells in the phase shifter can be addressed individually for a multi-bit operation and can possibly result in 10 phase states.

Figure 9:
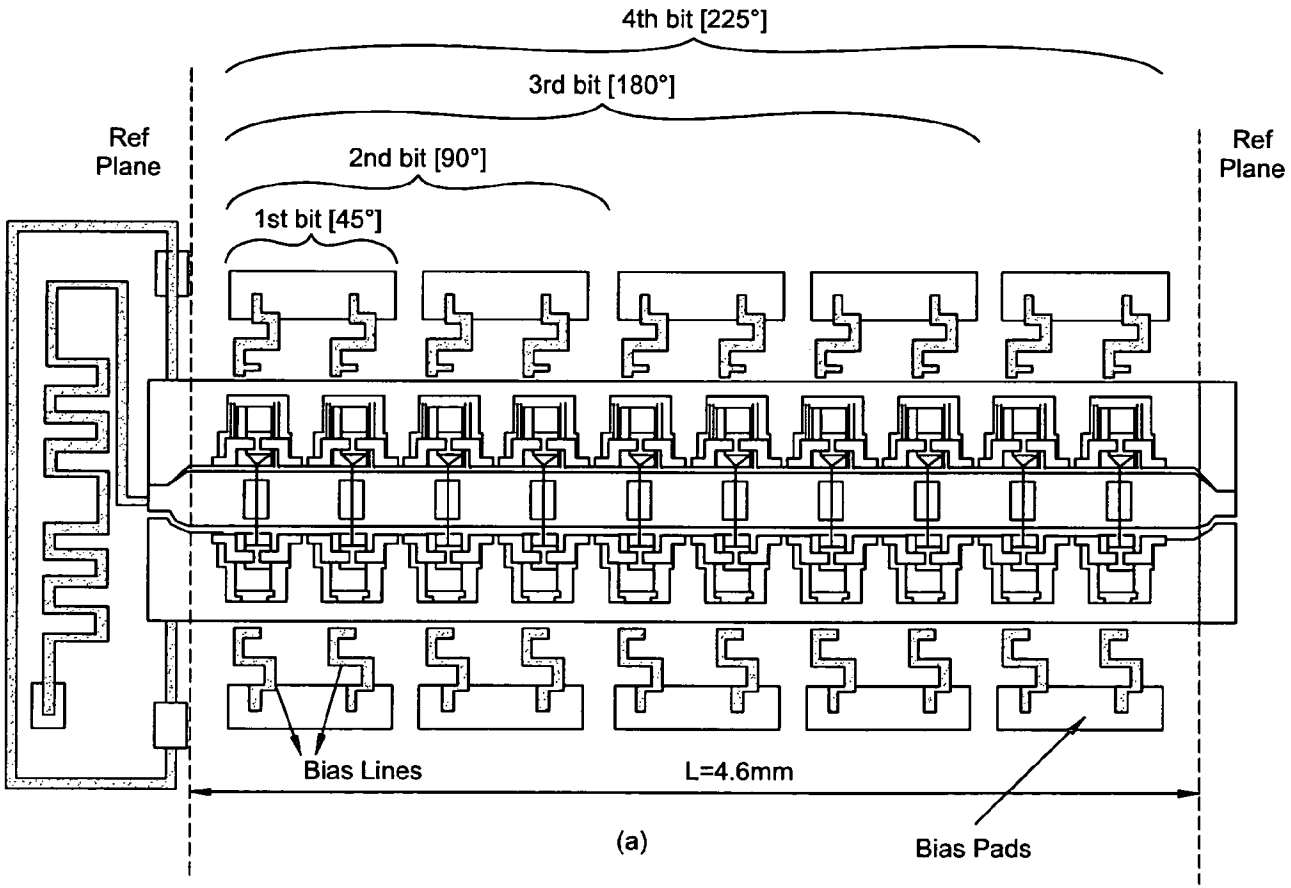
FIG. 9 is an illustrative view of a 4-bit MEM slow-wave phase shifter in accordance with the present invention.
Figure 10:
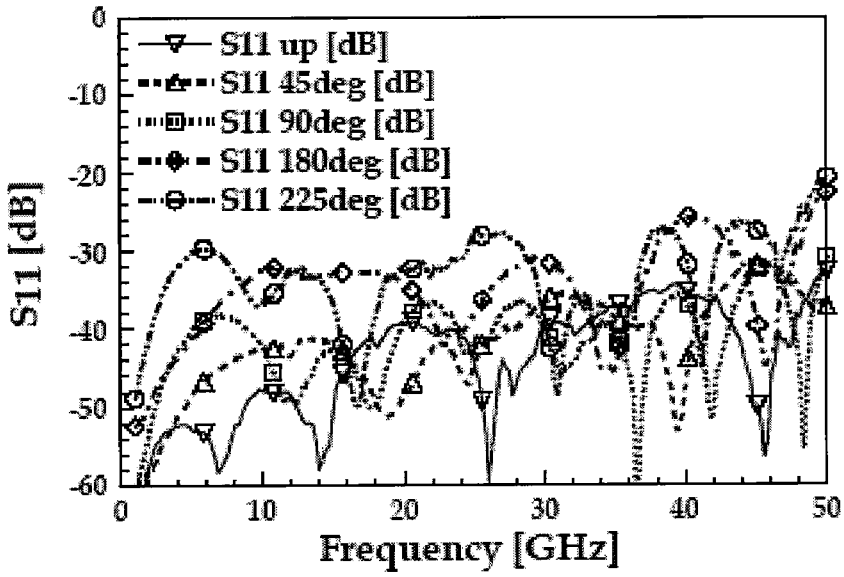
FIG. 10 is an illustrative view of the S11 of the 4-bit slow-wave MEM phase shifter in the various states as identified, in accordance with the present invention.
Figure 11:
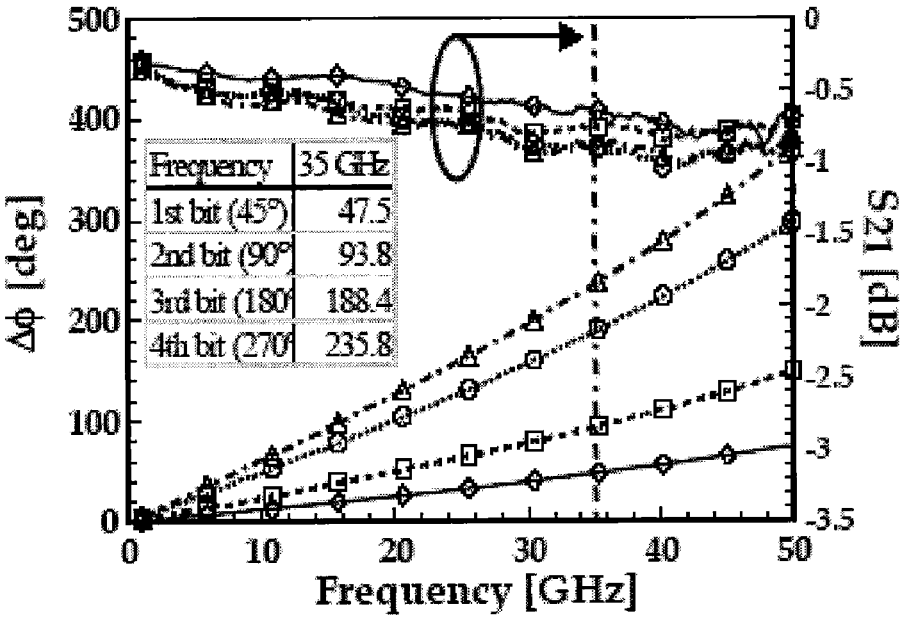
FIG. 11 is an illustrative view of the comparison of S11 and the differential phase shift for the states of the 4-bit slow-wave MEM phase shifter in accordance with the present invention.

In an additional embodiment, an electronically tunable Thru-Reflect-Line (TRL) calibration set that utilizes a 4-bit true time delay MEMS phase shift topology in accordance with the present invention is provided. With reference to FIG. 9, a 4-bit phase shifter is illustrated consisting of 10 cascaded slow-wave unit cells and is designed to provide small variations in the impedance around 50Ω on a 500 μm thick quartz substrate. The states of the phase shifter in accordance with this embodiment provide Δϕ of 45°, 90°, 180° and 225° at 35 GHz. In an exemplary embodiment, measurements of the electronically tunable TRL were performed from 1-50 GHz. A multi-line TRL calibration was performed using conventional calibration standards fabricated on the wafer. FIG. 10 illustrates the measured S11 for the phase shifter in all the states, while FIG. 11 illustrated the measured Δϕ and worst case S21 (dB) for the 4-bit phase shifter. As such, a true-time-delay 4-bit CPW phase shifter operating from 1-50 GHz is within the scope of the present invention that utilizes slow-wave MEMS sections. The experimental results for this embodiment demonstrate S11 less than −21 dB through 50 GHz with Δϕ/dB of approximately 317°/dB at 50 GHz. Accordingly, an electronically tunable calibration is made possible by realizing all the line standards using the multi-bit phase shifter in a multi-line TRL. The Tunable TRL device and method in accordance with the present invention provide for an efficient usage of wafer area while retaining the accuracy associated with the TRL technique, and reduces the number of probe placements from five to two, with potentially no change in probe separation distance.

Figure 12:
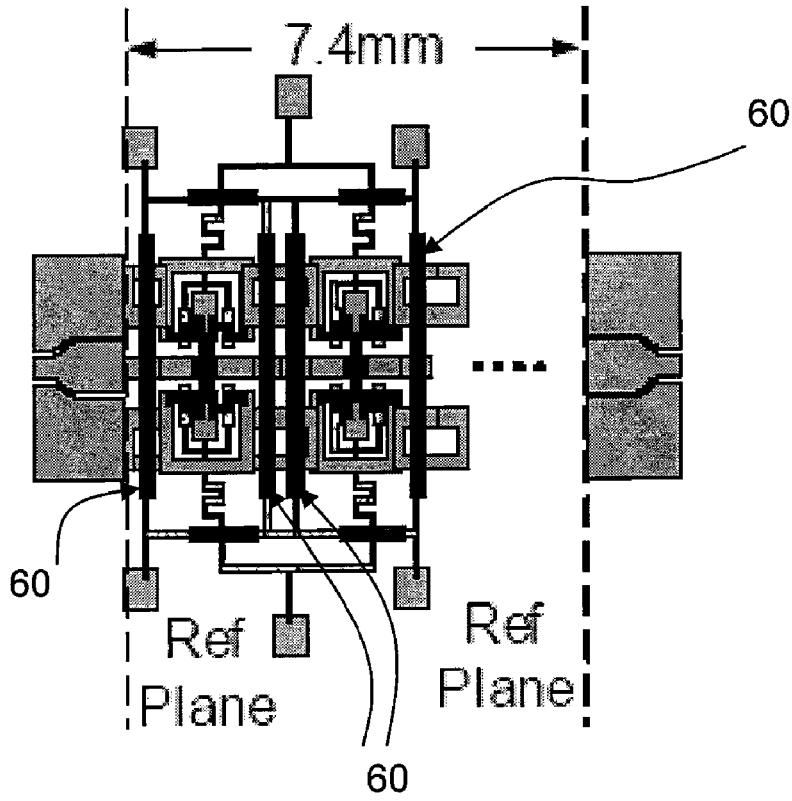
FIG. 12 is an illustrative view of a 1-bit phase shifter employing maximum phase shift by actuating the MAM capacitors in the delay state of the slow-wave sections.

In yet another embodiment, a reconfiguration MEMS-based transmission line in which there is independent control of the propagation delay and the characteristic impedance is provided. In accordance with this embodiment, separate control of inductive and capacitive MEMS slow-wave devices in accordance with the present invention are used either to maintain a constant LC product (constant $Z_o$) or a constant L/C ratio (constant β), while changing the ratio or product, respectively. With reference to FIG. 12, a device in accordance with this embodiment is shown in which a slow-wave device with metal-air-metal (MAM) capacitors 60 at the input and the output of the slow-wave device are provided. With this embodiment, $Z_o$-tuning is realized by operating the slow-wave section in conjunction with the MAM capacitors: the low-$Z_o$ mode corresponds to the normal state with actuated MAM capacitors, which the high-$Z_o$ is realized in the delay state with non-actuated MAM capacitors. Maintaining a constant propagation constant (β) with $Z_o$-tuning is achieved by proper selection of the capacitance ratio ($C_r$=$C_{max}$/$C_{min}$). Specifically, Δϕ due to the MAM capacitor ($\Delta\phi_{MAM}$), separated by a 270 μm long uniform CPW line, offsets the Δϕ due to the slow-wave section ($\Delta\phi_{slow\text{-}wave}$). For a given spacing (s) between capacitors and the total length (L), equation (2) is used to calculate $C_r$.

$$\Delta\phi = \left(\omega\sqrt{L_t C_t}\right)\times\left[\sqrt{1+\frac{C_b}{sC_t}} - \sqrt{1+\frac{C_r C_b}{sC_t}}\right] L\text{rad} \tag{2}$$

Where, $L_t$ and $C_t$ are the per-unit-length inductance and capacitance in the normal state. Using (2), $C_r$=2.6 for Δϕ=46', s=270 μm, $C_b$=24 fF, $L_t$=0.33 nH/mm, Ct=0.07 pF/mm, and L=740 μm.

The different $Z_o$ levels are determined by considering the transmission line section between MAM capacitors (the slow-wave section) as a uniform CPW line. The effective impedance ($Z_{eff}$) is then calculated using (3). For the distributed parameters used herein, $Z_{eff}$ can be set to approximately 38Ω or 50Ω; parasitic loading of the shunt beam and other discontinuity effects increase the actual levels to 40/52Ω values stated above.

$$Z_{eff} = \sqrt{\frac{L_t}{1+\frac{C_b}{sC_t}}} \tag{3}$$

Figure 13:
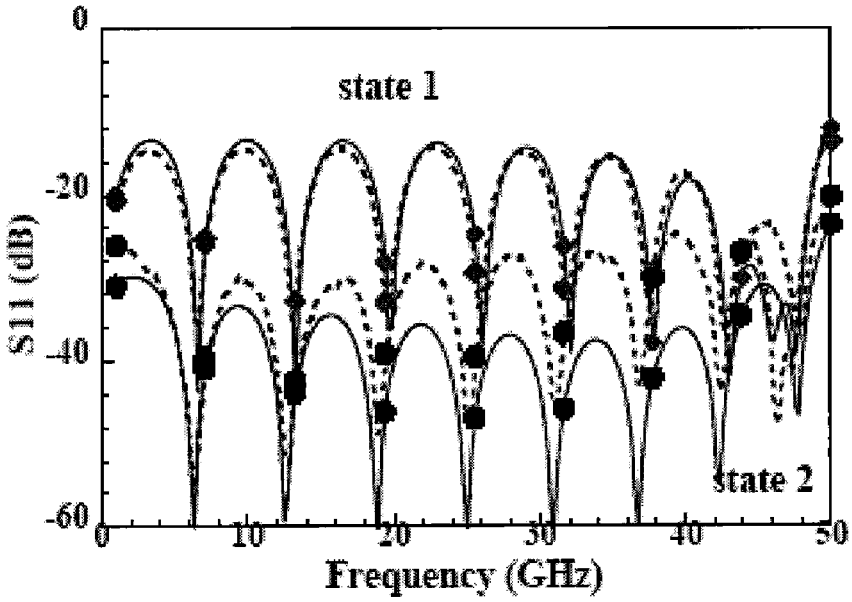
FIG. 13 is an illustrative of the comparison of measured (dashed) and simulated (solid) S11 (dB) of a 7.4 mm-long tunable $Z_o$-line with constant propagation constant in both states.

With reference to FIG. 12, a 1-bit phase shifter with maximum phase shift by actuating the MAM capacitors in the delay state of the slow-wave sections is illustrated. FIG. 13 illustrates the measures S11 for the phase shifter in accordance with this embodiment in both states and a comparison of the differential phase shift between the measured and simulated results.

Accordingly, a method and apparatus is provided that has application in many areas. Including, but not limited to, dynamically-controlled planar transmission line standards for electronic-calibration of vector network analyzers. In particular, standards for use with the Thru-Reflect-Line (TRL) calibration method and other calibration methods that include the use of two or more lines of varying electrical length are provided. Additional uses include, tunable distributed filter topologies which incorporate transmission line "stubs" of varying electrical length that are spaced by varying electrical lengths, and other tunable components that operate on the distributed transmission line principle, including but not limited to couplers, impedance matching networks, balanced-to-unbalanced transformers (BALUNS), and various transitions between different planar transmission line topologies, such as coplanar waveguide to slotline transitions.

It will be seen that the advantages set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween. Now that the invention has been described,

What is claimed is:

1. A method of manufacturing a microelectromechanical slow-wave phase shifter device, the method comprising the steps of:

providing a quartz substrate;

defining at least one bias line;

forming a ground isolation layer positioned where the at least one bias line enters a ground conductor;

defining at least one coplanar waveguide line;

spin coating and etching a sacrificial layer using;

removing the mask layer;

evaporating a seed layer and patterning the seed layer to define at least one microelectromechanical bridge;

gold-electroplating the at least one microelectromechanical bridge;

removing the photoresist layer and seed layer;

annealing to flatten the at least one microelectromechanical bridge;

removing the sacrificial layer; and releasing the microelectromechanical bridges using critical point drying.

2. The method of claim 1, wherein the quartz substrate is 500 μm in thickness.

3. The method of claim 1, wherein the step of defining the at least one bias line further comprises defining at least one bias line having a thickness of 1000 Å.

4. The method of claim 1, wherein the step of depositing and patterning a $Si_xN_y$ layer further comprising depositing a patterning a 4000 Å $Si_xN_y$ layer.

5. The method of claim 1, wherein the step of defining at least one coplanar waveguide line further comprises defining at least one coplanar waveguide by evaporating a Cr/Ag/Cr/Au line to a thickness of 150/8000/150/1500 Å.

6. The method of claim 1, wherein the step of spin coating and etching a sacrificial layer further comprises spin coating and etching a sacrificial layer wherein the layer thickness can be varied between about 1.5 cm to about 2 μm by varying the rotational speed of the spinner between about 2500 rpm to about 1500 rpm.

7. The method of claim 6, wherein layer thickness between about 1.8 μm and about 2 μm.

8. The method of claim 1, where in the step of evaporating a seed layer and patterning the seed layer to define at least one microelectromechanical bridge further comprise evaporating a 100/2000 Å Ti/Au seed layer.

9. The method of claim 1, wherein the step of gold-electroplating the microelectromechanical bridges further comprises the step of gold-electroplating to a thickness of about 1 μm.

10. The method of claim 1, wherein the step of annealing the device further comprises the step of annealing the device at between about 105° and about 120° to flatten the microelectromechanical bridges.

* * * * *